US005386603A

United States Patent [19]

Drust

[11] Patent Number: 5,386,603

[45] Date of Patent: Feb. 7, 1995

[54] WATERPROOF BACKED BLANKET

[76] Inventor: Rosann Drust, 593 Irmen, Wood Dale, Ill. 60191

[21] Appl. No.: 232,606

[22] Filed: Apr. 25, 1994

[51] Int. Cl.[6] ..... A47G 9/06

[52] U.S. Cl. ..... 5/417; 5/484; 5/656

[58] Field of Search ..... 5/413, 417–420, 5/47.3, 656, 484

[56] References Cited

U.S. PATENT DOCUMENTS

| | | | |
|---|---|---|---|
| 3,058,124 | 5/1961 | Sturtevant | 5/345 |
| 3,477,552 | 11/1969 | Goldman | 5/413 |
| 4,097,944 | 7/1978 | Yulish | 5/419 |
| 4,278,719 | 7/1981 | Sarnecki | 428/78 |
| 4,295,235 | 10/1981 | Deitz | 5/473 |
| 4,601,195 | 7/1987 | Trahan et al. | 5/417 X |
| 5,291,625 | 3/1994 | Leslie | 5/420 |

FOREIGN PATENT DOCUMENTS

| | | | |
|---|---|---|---|
| 2231791 | 11/1990 | United Kingdom | 5/417 |

*Primary Examiner*—Michael F. Trettel
*Attorney, Agent, or Firm*—Philip. Kier

[57] ABSTRACT

The invention discloses a waterproof blanket to provide protection from ground moisture for use by picnickers and others. It has a waterproof layer, for contact with the ground, and a non-waterproof, comfortable layer. It is oval in shape. The blanket can be folded and then rolled so that it can be readily transported. Adhesive belts keep the blanket in its rolled configuration when it is being transported. It may also have an attached carrying strap.

1 Claim, 2 Drawing Sheets

WATERPROOF BACKED BLANKET

BACKGROUND

1. Field of the Invention

This invention relates generally to blankets, and more particularly to blankets with a waterproof backing to provide protection from ground moisture for picnickers and others.

2. Description of the Related Art

A terrycloth beach towel with a waterproof backing is described in U.S. Pat. No. 4,278,719 issued Jul. 14, 1981 under the title "Waterproof Backed Towel." This beach towel has a nylon backing with a folded over hem. A waterproof cushion for use on boats with vents to allow the cushion to yield to pressure for the comfort of the user is described in U.S. Pat. No. 3,058,124 issued Oct. 16, 1961 under the title "Cushion Construction." A cushion for use on outdoor furniture with an interlayer of water impervious material to prevent moisture from diffusing from one side layer to another side layer is described in U.S. Pat. No. 4,295,235 issued Oct. 20, 1981 under the title "Waterproof Cushion For Outdoor Use and Method for Manufacturing The Same."

SUMMARY OF THE INVENTION

Picnickers or persons attending outdoor concerts frequently use a conventional blanket as a barrier to direct contact with the ground. A conventional blanket is light, easily transported, and provides some cushioning effect to enhance comfort. However, if the ground is damp, moisture may seep through the conventional blanket. The present invention has the object of combining the light weight and easy transportability of a conventional blanket with the property of being waterproof.

In accordance with the invention, this object and other objects can be obtained by providing a blanket with two layers. One layer is made of a waterproof material, such as vinyl. The other layer is a confortable material, such as cotton flannel. The two layers may be joined by sewing along the edges. When in use, the waterproof layer faces the ground. This blanket is oval in shape. It can be folded and then rolled to form a compact roll that can comfortable be carded in the crook of an arm. On the outside of the waterproof layer are adhesive belts to keep the blanket in its rolled shape. The blanket can be folded and rolled in such a way to keep the non-waterproof layer dry. It may also have a carrying strap.

DESCRIPTION OF THE PREFERRED EMBODIMENT

Figure 1:
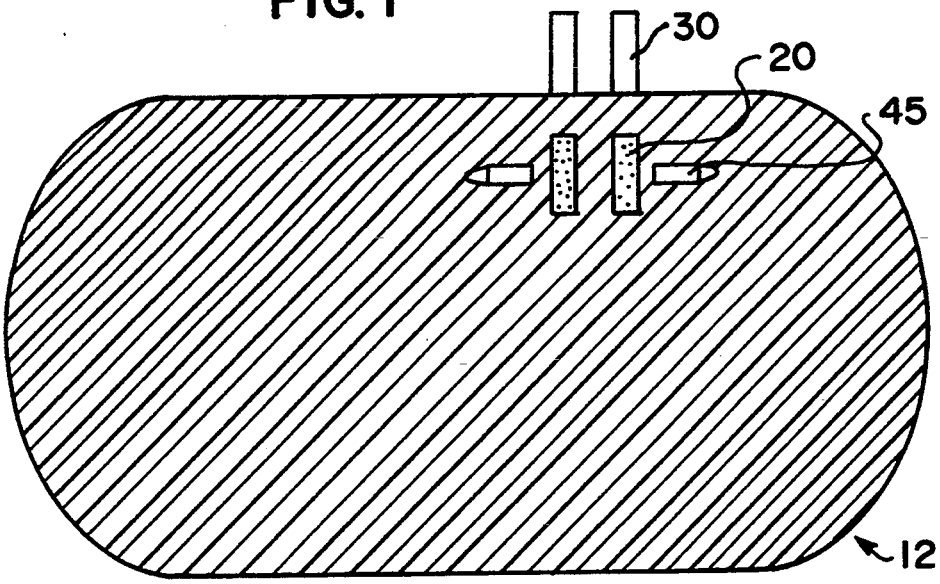
FIG. 1 is a view of the waterproof layer of a blanket constructed according to the present invention.
Figure 2:
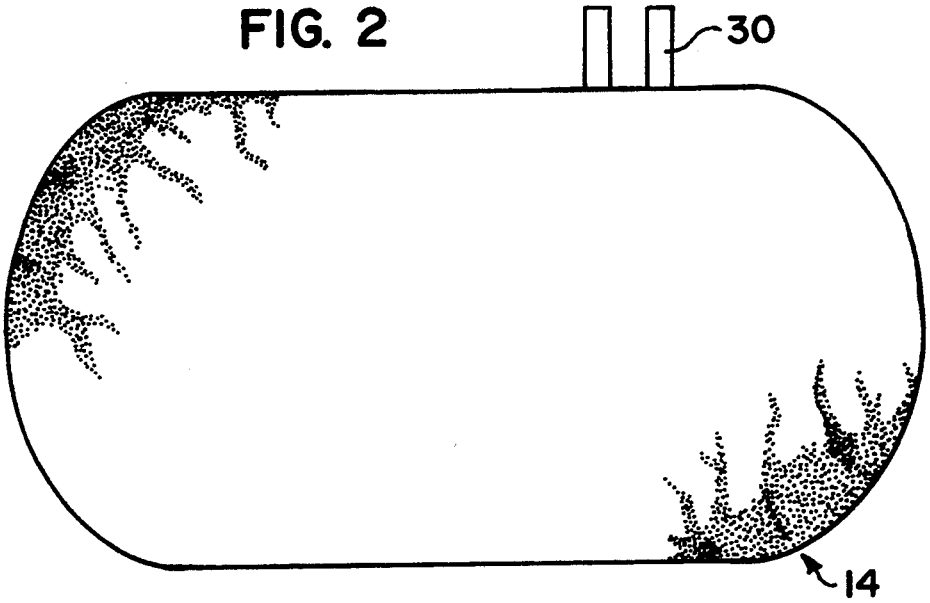
FIG. 2 is a view of the non-waterproof layer of a blanket constructed according to the present invention.

Referring now to the drawings, the present invention is a blanket generally designated by reference character 10. The blanket is generally oval in shape and large enough for two adults to lie on the blanket or for four adults to sit on. An oval shapes is preferrable to a rectangular shape because the sharp comers on a rectangular has a tendency to be lifted by the wind. The blanket has a waterproof layer 12 and a non-waterproof layer 14. The non-waterproof layer is perferrably a material that comfortable to the touch such as cotton flannel. The waterproof layer is perferrably made of a vinyl material. The two layers may be sewn together. On a side of the waterproof layer that is in contact with the ground when the blanket is in use are two adhesive belt bases 20, as shown in FIG. 1. There are also two adhesive belts 30 attached to a straight edge of the blanket. In the preferred embodiment, one side of the belts and the belt bases are made of synthetic materials that adhere when pressed together and sold under the trademark "Velcro."

Figure 3:
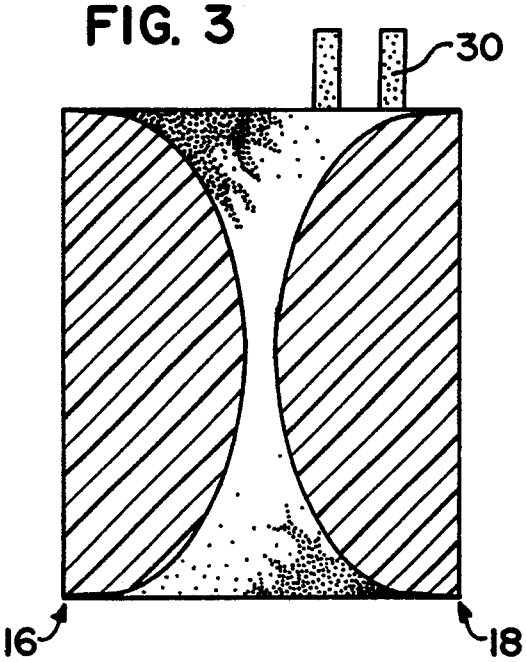
FIG. 3 is a view of the blanket with its oval ends folded over the waterproof layer.
Figure 4:
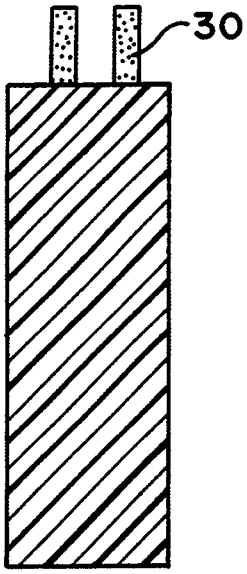
FIG. 4 is a view of the blanket folded in preparation for being rolled up.
Figure 5:
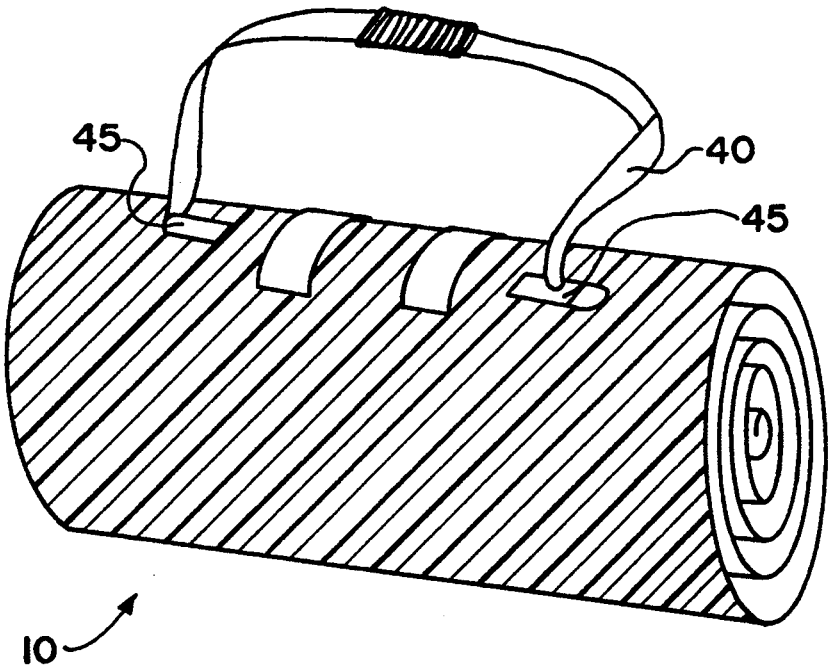
FIG. 5 is a perspective view of the blanket after it has been rolled up.

The blanket can be folded and rolled to keep the non-waterproof layer dry after use as follows. As shown in FIG. 3, each semicircular part of the blanket 16 and 18 is folded over such that the edges of the semicircular parts touch or are in close proximity. After this step, the blanket has a rectangular shape that is nearly square. Next, the blanket can be folded again as shown in FIG.4. Then, the blanket can be rolled up and be secured in the rolled position by pressing together the adhesive sides of the belts and belt bases. The blanket can be held confortably in the crook of the arm carrying it. In the preferred embodiment, the blanket also has a carrying strap 40 and, on the waterproof layer, strap bases 45 to which the strap can be attached, as shown in FIG. 5. The carrying strap can be hand-held or looped over a shoulder.

I claim:

1. A blanket comprising a waterproof layer; a non-waterproof layer; a plurality of adhesive belts attached to a side of said blanket; and an attachable carrying strap and two strap bases to which said carrying strap can be attached; said waterproof layer being constructed of a vinyl material, having a plurality of adhesive belt bases; and being integrally joined with said non-waterproof layer; said blanket being generally oval in shape with two parallel sides and two opposing semicircular sides; and said adhesive belts and said belt bases being oriented such that when said blanket is folded three times and then rolled up, the belts and belt bases will be aligned.

* * * * *